US007857155B2

(12) United States Patent
Roberts et al.

(10) Patent No.: US 7,857,155 B2
(45) Date of Patent: Dec. 28, 2010

(54) CLOSURE FOR HIGH TORQUE INSTALLATION ON A CONTAINER

(75) Inventors: Charles E. Roberts, Eagle, WI (US); Stacy L. Beilke, Eagle, WI (US)

(73) Assignee: Seaquist Closures L.L.C., Mukwonago, WI (US)

( * ) Notice: Subject to any disclaimer, the term of this patent is extended or adjusted under 35 U.S.C. 154(b) by 926 days.

(21) Appl. No.: 11/714,624

(22) Filed: Mar. 6, 2007

(65) Prior Publication Data

US 2008/0217286 A1 Sep. 11, 2008

(51) Int. Cl.
*B65D 41/04* (2006.01)
*B65D 47/00* (2006.01)
*B65D 51/18* (2006.01)

(52) U.S. Cl. ..... 215/329; 215/235; 215/295; 215/305; 220/254.3; 220/288; 222/556; 222/562; 222/563

(58) Field of Classification Search ..... 215/235, 215/305, 329, 295; 220/288, 254.3; 222/556, 222/562, 563

See application file for complete search history.

(56) References Cited

U.S. PATENT DOCUMENTS

| | | | | |
|---|---|---|---|---|
| 2,586,775 | A * | 2/1952 | Benner et al. | 215/329 |
| 4,278,180 | A * | 7/1981 | Willis | 215/252 |
| 5,381,912 | A * | 1/1995 | Walker et al. | 215/220 |
| 5,941,404 | A * | 8/1999 | Charrette | 215/305 |
| 2008/0197101 | A1 * | 8/2008 | Rapoport | 215/252 |

OTHER PUBLICATIONS

Figures A, B, C, D, E, and F on sheets 1-6.

* cited by examiner

*Primary Examiner*—Robin Hylton
(74) *Attorney, Agent, or Firm*—Wood, Phillips, Katz, Clark & Mortimer

(57) ABSTRACT

A closure that can be threadingly screwed onto an associated container includes a body having a thread form for engaging a thread form on the container. The body has a wall with projecting hook-like ribs. By the provision of the hook-like ribs, the closure exhibits an enhanced capability for being gripped by the rollers of an automatic capping machine, to accommodate a relatively high torque installation without slipping in an automatic capping machine.

9 Claims, 8 Drawing Sheets

CLOSURE FOR HIGH TORQUE INSTALLATION ON A CONTAINER

TECHNICAL FIELD

This invention relates to a threaded closure for being screwed onto a container.

BACKGROUND OF THE INVENTION AND TECHNICAL PROBLEMS POSED BY THE PRIOR ART

A variety of packages, including dispensing packages that include a container and a closure, have been developed for personal care products such as shampoo, lotions, etc., as well as for other fluent materials. A closure is typically mounted over the container opening. In many types of packages, both the closure and container are threaded so that the closure can be initially screwed on the container by an automatic capping machine.

Depending upon the size of the container, the size of the closure, and the materials from which the container and closure are made, it can be desirable in some applications to provide the capability for screwing the closure onto the container with a relatively high torque.

In a typical conventional design of a closure, the closure is provided with a cylindrical, exterior, peripheral wall. In conventional, high speed, high-volume manufacturing processes, the closure is installed on the container by an automatic capping machine which incorporates rubber rollers or rolls for engaging the peripheral wall of the closure. The automatic capping machine rollers are typically made from a somewhat soft, resilient material, such as rubber. The capping machine rollers are rotated while in frictional engagement against the closure peripheral wall to impart a rotation to the closure for screwing the closure on to the container.

In some conventional closure designs, the peripheral wall of the closure is includes vertical flutes or ribs. The flutes or ribs have a generally V-shaped transverse cross section (as viewed in a plane perpendicular to the vertical height of each rib), and such a flute or rib feature increases the frictional engagement between the capping machine rollers and the closure.

It would be desirable in some applications to provide an improved closure having an enhanced capability for being gripped by the rollers of an automatic capping machine. Further, it would be advantageous if such an improved closure could accommodate a relatively high torque installation without slipping in an automatic capping machine.

It would be desirable to provide an improved closure wherein the enhanced gripping feature would work well with conventional capping machine rollers. Such an improved closure should also preferably accommodate closures constructed from a variety of materials and having various sizes.

It would also be beneficial if such an improved closure could accommodate the efficient, high-quality, high-speed, high-volume processing techniques for applying closures, and could accommodate such techniques with a reduced package reject rate to produce packages having consistent operating characteristics package-to-package with high reliability.

SUMMARY OF THE INVENTION

An improved closure of the present invention can accommodate designs that include one or more of the above-discussed desired features or capabilities. According to one aspect of the present invention, a closure is provided for a container that has an opening to the container interior where a product may be stored and that has a screw thread form. The closure includes (A) a screw thread form for engaging the container screw thread form to permit the closure to be screwed on to the container, and (B) a peripheral, gripable wall having a plurality of circumferentially spaced flutes or ribs. At least some of the flutes or ribs each have (1) a leading side that generally faces toward the screwing on direction of rotation, and (2) a trailing side that (a) generally faces toward the unscrewing direction of rotation, and (b) has a hook-like configuration defining a recess which is open toward the unscrewing direction of rotation.

In a particularly preferred embodiment of the present invention, each hook-like configuration has a distal end that is radially outwardly of the recess and that defines a projection extending in or toward the unscrewing direction of rotation relative to the recess.

The present invention permits the use of mechanical advantage or leverage when applying a threaded closure to a container. The novel design of the flutes or ribs permits increased torque to be transferred by the conventional automated capping machine rollers without the use of additional mechanical devices or torque application modifications of the capping machine. The novel flute or ribbed design can be used either intermittently around a 360° vertical, peripheral surface of the closure or substantially continuously around the closure. The flutes or ribs can have varying heights at various locations around the circumference of the closure. The radially projecting, distal, vertical end portions of each flute or rib can have variations in shape from flat, to rounded, to a single sharp edge. The angle or orientation of the flutes or ribs can vary depending upon the closure size and aesthetic design considerations.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
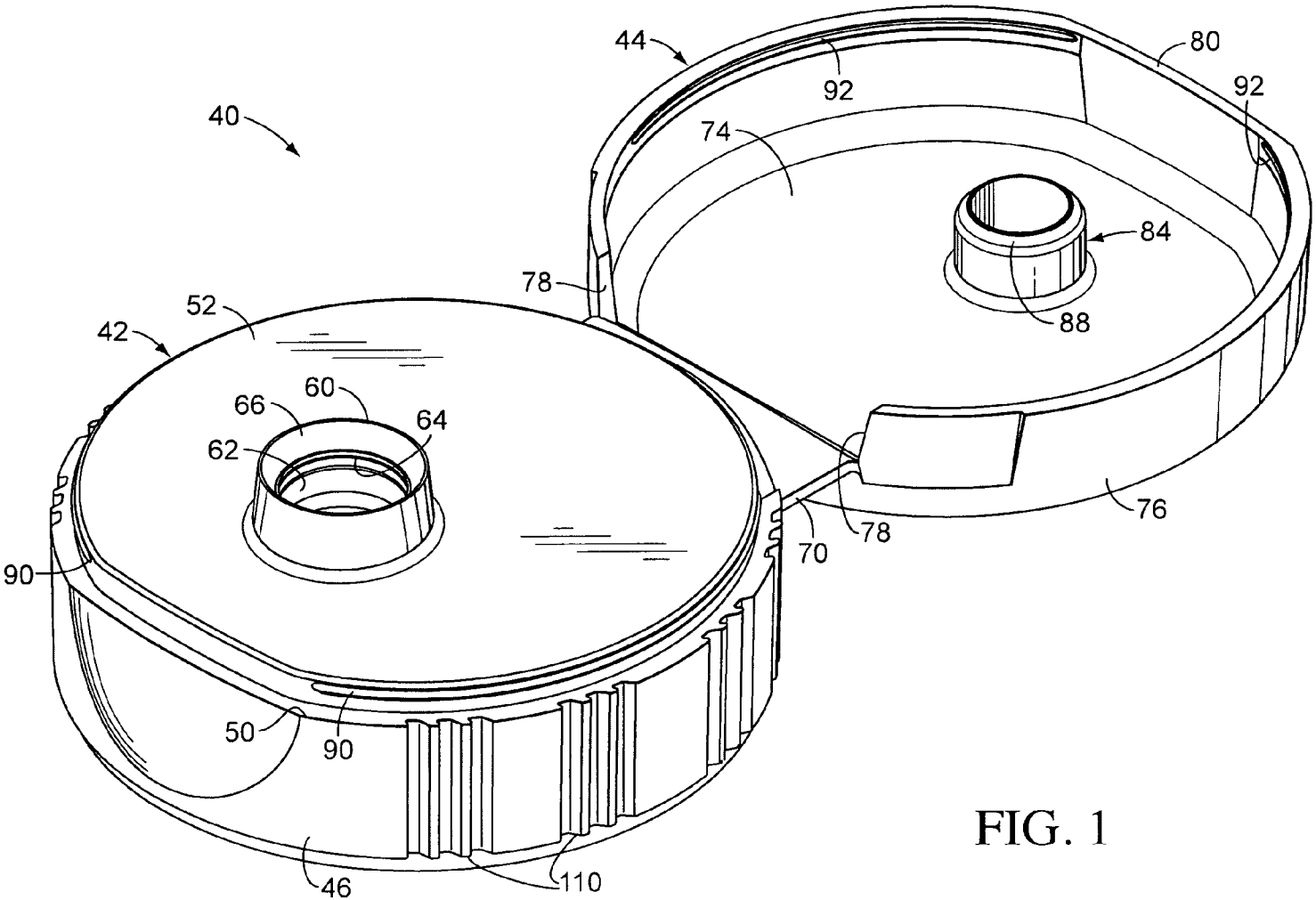
FIG. 1 is a top, isometric view of a first embodiment of a dispensing closure of the present invention with the lid opened in an as-molded condition after the closure has been molded from a suitable thermoplastic material.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in particular orientations, and terms such as upper, lower, horizontal, etc., are used with reference to these orientations. It will be understood, however, that the closure may be manufactured, stored, and used in orientations other than the ones described.

With reference to the figures, a first embodiment of a closure of the present invention is illustrated in FIGS. 1-7 and is identified generally in some of those figures by reference number 40. The closure 40 is adapted to be disposed on, and threadingly screwed on to, a container (not illustrated) which may have a conventional mouth or opening formed by a neck or other suitable structure.

The container may be stored and used in an upright orientation wherein the closure 40 is at the top of the container. The container may also be normally stored in an inverted position (not illustrated). When stored in the inverted position, the container employs the closure 40 as a support base.

In the preferred first embodiment illustrated in FIGS. 1-7, the closure 40 is a separate article in the form of a dispensing closure 40 which is adapted to be removably, or non-removably, threadingly installed on a previously manufactured container that has an opening to the container interior.

The illustrated, preferred embodiment of the closure 40 is adapted to be used with a container having an opening to provide access to the container interior and to a product contained therein. The closure 40 can be used to dispense many materials, including, but not limited to, relatively low or high viscosity liquids, creams, gels, suspensions, mixtures, lotions, etc. (such as a material constituting a food product, a beverage product, a personal care product, an industrial or household cleaning product, or other compositions of matter (e.g., compositions for use in activities involving manufacturing, commercial or household maintenance, construction, agriculture, medical treatment, military operations, etc.)).

The container with which the closure 40 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system, or to reduce the exterior ambient pressure so as to suck the material out through the open closure.

It is presently contemplated that many applications employing the closure 40 will conveniently be realized by molding the closure 40 from suitable thermoplastic material or materials. In the preferred embodiment illustrated, the closure could be molded from a suitable thermoplastic material, such as, but not limited to, polypropylene.

As can be seen in FIG. 1, the closure 40 includes a base or body 42 and a lid 44 mounted on the body 42. Throughout this specification, the terms "base" and "body" will be used interchangeably. The base or body 42 includes an exterior skirt or peripheral wall 46 which has conventional, internal thread (48 (FIG. 6) for connection to the mating thread of a container (not illustrated).

Figure 6:
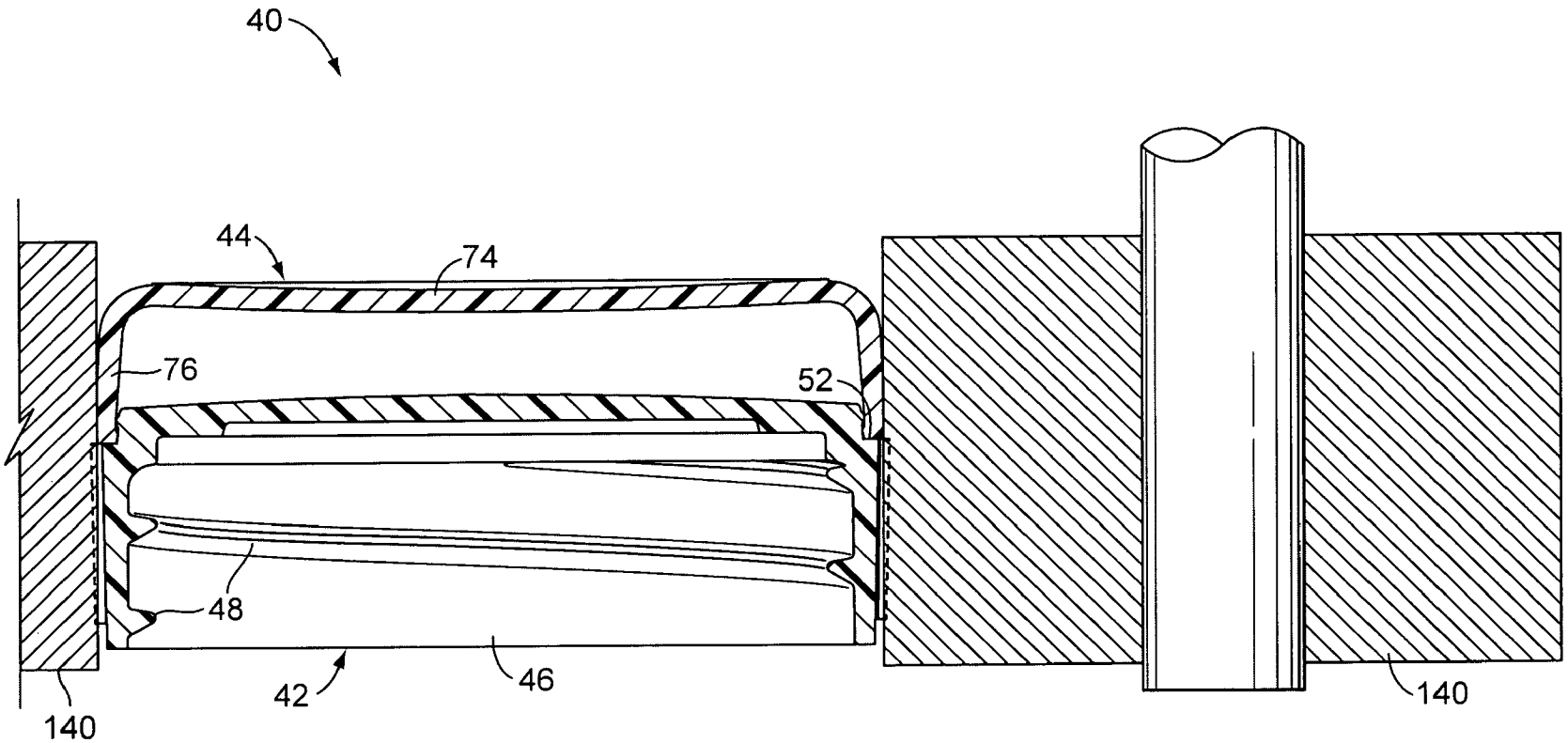
FIG. 6 is a simplified, cross-sectional view taken generally along the plane 6-6 in FIG. 5.

At the top of the closure base skirt 46 as shown in FIG. 1, the skirt 46 terminates in a shoulder 50 around a transverse deck 52. As can be seen in FIG. 6, the shoulder 50 receives the lid 44 when the lid 44 is closed.

With reference to FIG. 1, a spout in the form of a collar 60 projects upwardly from the closure body deck 52 to define a discharge aperture 62. Part of the discharge aperture 62 extends from the collar 60 downwardly through the deck 52. The interior upper end portion of the collar 60 has a reduced diameter sealing bead 64 (FIG. 1). Above the sealing bead 64, the distal end of the collar 60 and has a chamfered or frustoconical surface 66.

In the preferred embodiment, the closure a lid 44 (FIG. 1) is connected to the closure body skirt 46 with a hinge structure 70. The lid 44 has a generally flat top deck or cover 74 (FIG. 1) which, in the preferred embodiment, is slightly concave. With reference to FIG. 22, the lid 44 includes a peripheral wall 76 extending generally perpendicularly from the periphery of the top or cover 74.

The rear end of the lid 44 is connected to the hinge structure 70. To accommodate the hinge structure 70, the rear part of the peripheral wall 76 of the lid 44 has a notch 78 (FIG. 1).

Figure 2:
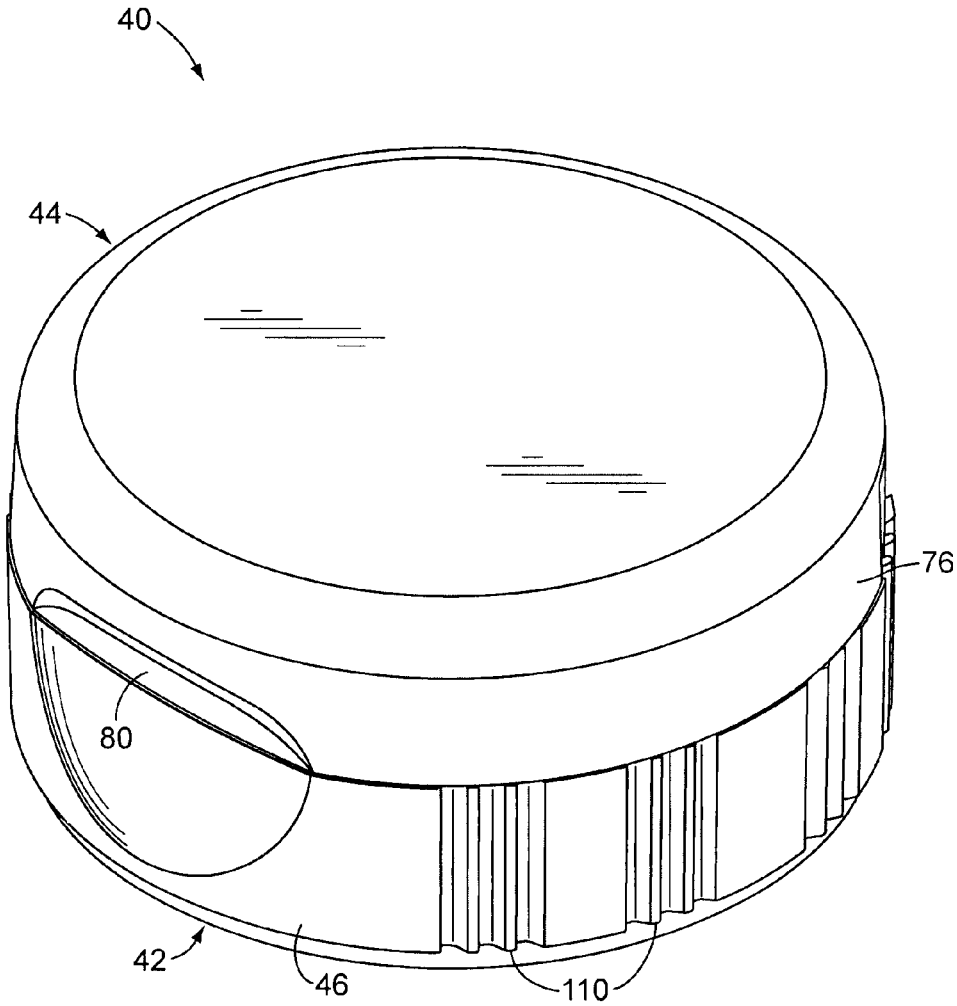
FIG. 2 is an isometric view similar to FIG. 1, but FIG. 2 shows the lid closed.
Figure 3:
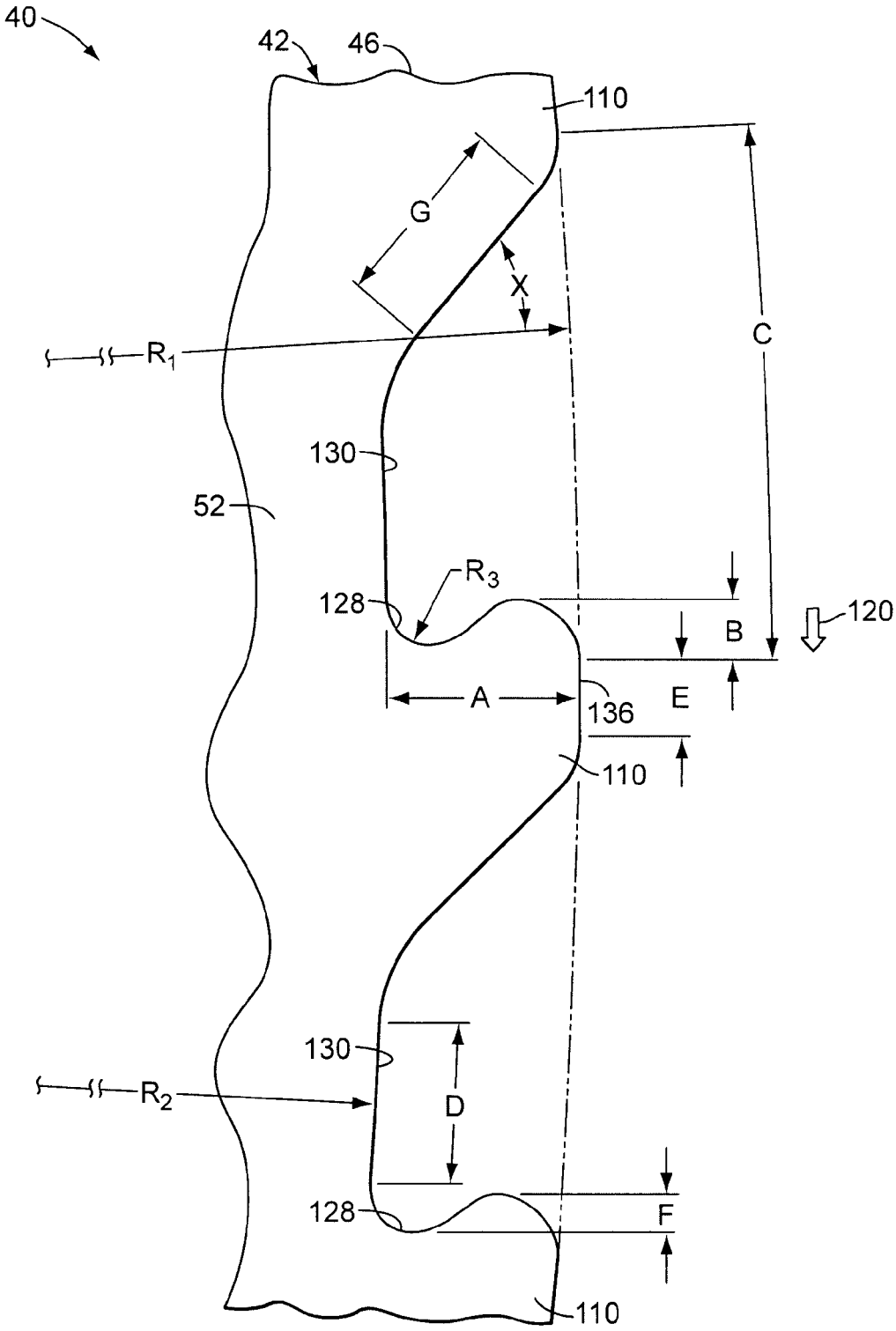
FIG. 3 is a greatly enlarged, fragmentary, top plan view of a portion of the peripheral edge of the closure body shown in FIG. 1 with dimensions for various features indicated.
Figure 4:
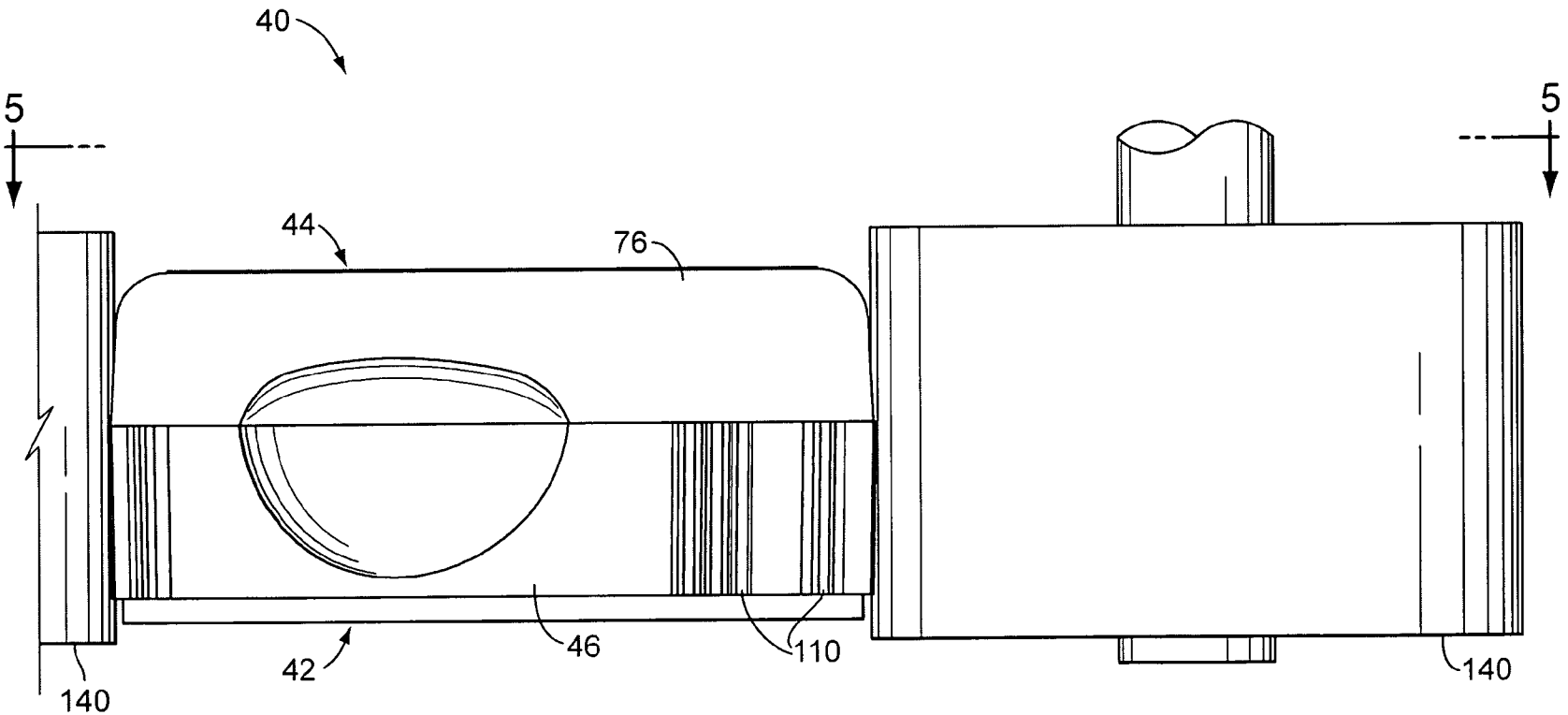
FIG. 4 is a fragmentary, side elevational view of the closed closure between rollers of an automatic capping machine with the closure in the orientation that the closure would have if the automatic capping machine was screwing the closure on an upwardly extending neck of a container (not illustrated in FIG. 4)
Figure 5:
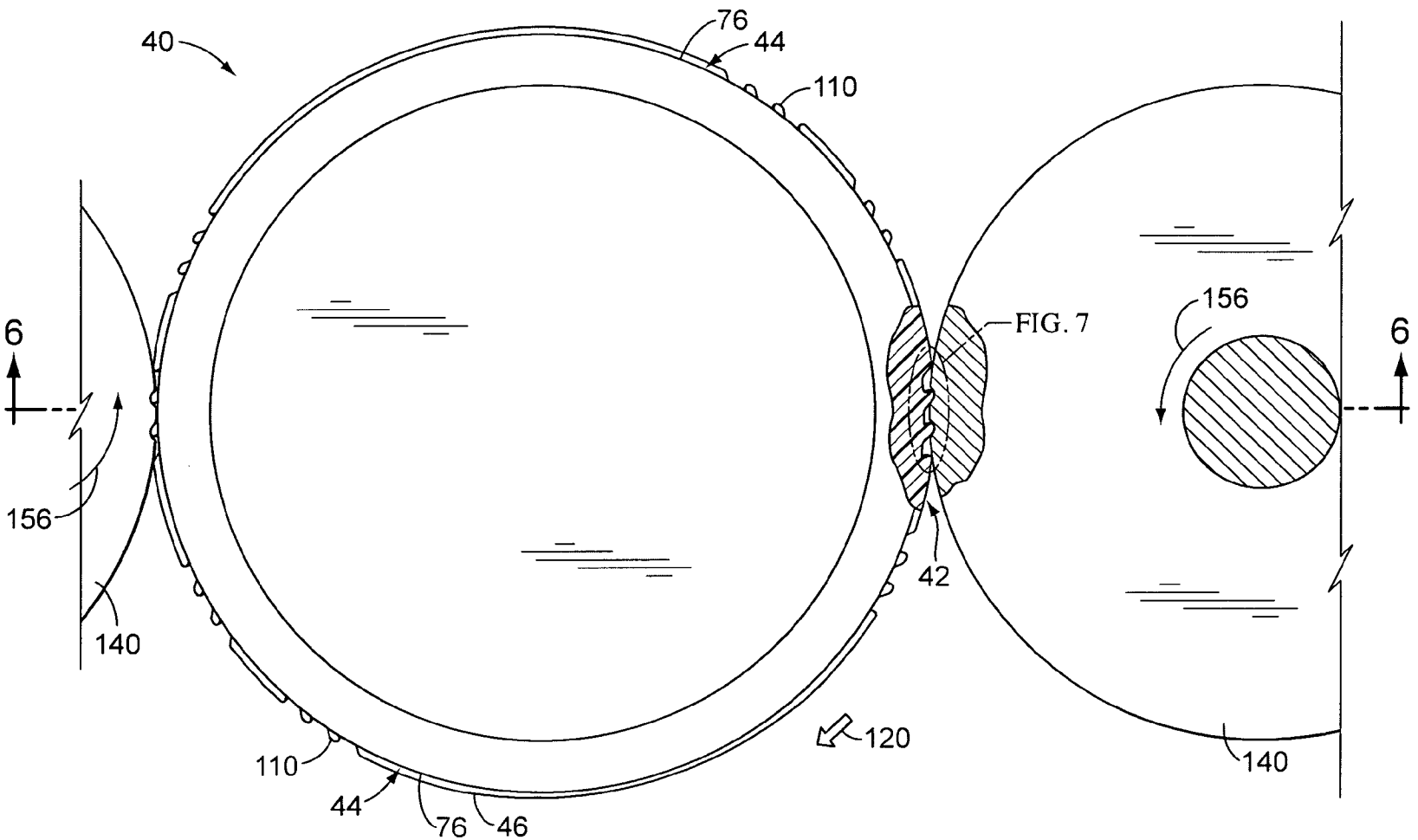
FIG. 5 is a simplified, fragmentary, top plan view taken generally along the plane 5-5 in FIG. 4, and in FIG. 5, portions have been broken away and shown in cross section to illustrate interior details.

As can be seen in FIG. 2, the front end of the wall 76 of the lid 44 includes a thumb lift surface 80. Extending from the underside of the lid cover 74 is an annular member or spud 84 (FIG. 1) which is adapted to be received in, and sealingly engage the interior of, the closure base collar 60 when the lid 44 is closed (in FIG. 6, the collar 60 and spud 84 are not visible because they are forward of the cross-section view plane 6-6 for FIG. 6 in FIG. 5 relative to the closure orientation shown in FIG. 4 on which FIG. 5 is based). In the preferred embodiment, the distal end of the spud 100 has a chamfer or frustoconical surface 102 (FIGS. 2 and 3).

The hinge structure 70 is preferably integrally molded as a unitary part of the closure with the base 42 and lid 44. One preferred material for molding the closure is polypropylene. It has been found that this material provides a relatively strong, durable closure hinge. The material has the capability for withstanding typical loads imposed on the hinge structure 70 by a user of the closure when the user opens and closes the lid 44, and has the capability for accommodating a relatively high number of opening and closing cycles without failure.

One suitable hinge structure 70 is the snap-action hinge disclosed in the U.S. Pat. No. 5,642,824. Other hinge structures could be employed, such as a living film hinge, a tether or strap, etc. The detailed design and operation of the hinge structure 70 form no part of the present invention.

In the preferred form of the closure illustrated, the lid 44 is normally maintained closed with a friction fit or interference fit between the lid spud 84 (FIG. 1) and the closure body collar 60 (FIG. 1). A conventional sealing bead or latch bead 88 (FIG. 1) is provided on the exterior of the lid spud 84 for engaging or interfering with the sealing bead 64 of the closure body collar 60. An additional retention force is provided by conventional snap-fit latch beads 90 around the edge of the deck 56 and by co-acting beads 92 on the inside of the lid peripheral wall 76.

It will also be appreciated that the closure of the present invention may be provided with a variety of dispensing passage structures other than the aperture 60 (FIG. 1). Also, the closure could be a removable, non-dispensing closure in the form of a unitary, screw-on cap having a unitary body without a separate dispensing aperture and without a co-acting, moveable lid per se.

The closure body skirt 46 maybe characterized as defining a peripheral, gripable wall with a plurality of circumferentially spaced, vertically oriented, flutes or ribs 110 (FIG. 1). In the preferred embodiment illustrated, the flutes or ribs 110 are oriented parallel to the longitudinal axis of the closure. However, in a contemplated alternate embodiment (not illustrated), the flutes or ribs 110 could be oriented at an angle to the longitudinal axis of the closure. As can be seen in FIGS. 5 and 6, the radially outermost portions of the ribs 110 may project somewhat radially outwardly of (beyond) the exterior surface of the overlying closed lid skirt 76.

The configuration of the ribs 110 will next be described in detail, particularly with reference to FIG. 3. In the top plan view of the peripheral portion of the closure body 46 illustrated in FIG. 3, the "screwing on" direction of rotation is designated by the arrow 120. The "unscrewing" direction of rotation is in the direction opposite to the direction indicated by the arrow 120 in FIG. 3. The screwing on direction of rotation is clockwise when viewed looking down on the top of the closure—and this is the normal screwing on direction for a conventional right-hand thread configuration. However, if the closure and container employ an unconventional, left-hand thread configuration, then the screwing on direction would, of course, be opposite to that indicated by the arrow 120 in FIG. 3, and in such a left-hand thread configuration system, the configuration of the ribs 110 would have to be reversed (i.e., as if FIG. 3 was viewed from the rear and turned 180°).

Each rib 110 has a leading side that faces generally toward the screwing on direction of rotation, and a portion of the length of the rib 110 designated by the reference letter G in FIG. 3 defines a planar portion of the leading side of the rib 110 which faces in the screwing on direction indicated by the arrow 120.

Each rib 110 includes a trailing side that generally faces toward the unscrewing direction of rotation and that has a hook-like configuration defining a projection in the unscrewing direction that is designated by the projection length F in FIG. 3. The hook-like configuration also defines a recess 128 (FIG. 3) which opens toward the unscrewing direction of rotation. In the preferred embodiment illustrated in FIG. 3, each recess 128 is defined by a circular arc surface having a radius $R_3$.

As can be seen in FIGS. 1 and 5, the preferred embodiment of the closure 40 has a plurality of groups of ribs 110 located around the circumference of the closure body 42. Each group of ribs contains two ribs 110. The groups 110 are not equally circumferentially spaced around the periphery of the closure body 42. A variety of different spacings maybe employed. In some contemplated alternate designs (not illustrated), the ribs 110 may be equally spaced around the periphery of the closure body 42 instead of being separated into groups of ribs which are not equally spaced around the periphery of the closure body.

With reference to FIG. 3, the ribs 110 define the largest circumference of the closure body or closure having a radius $R_1$. The closure wall 46 between two adjacent ribs 110 at the roots of the ribs 110 defines an inner convex circular arc surface 130 (FIG. 3) lying along, or on, a circular locus having a radius $R_2$. Each radius $R_1$ and $R_2$ originates at the longitudinal rotational centerline or axis of the closure 40. In the embodiment illustrated in FIG. 3, the radius $R_1$ is greater than the radius $R_2$. In a presently preferred embodiment, the radius $R_2$ is in the range defined between about 2% of $R_1$ and about 5% of $R_1$.

The inner circular arc surface 130 between two adjacent ribs 110 at the roots of the ribs 110 has an arc length D as shown in FIG. 3. Two adjacent ribs 110 define between them a circular arc length C (FIG. 3) as measured along the largest circumference (defined by radius $R_1$) between a point on one rib 110 at the largest circumference and a corresponding point on the adjacent rib 110 at the largest circumference. In a presently preferred embodiment as illustrated in FIG. 3, the inner circular arc surface length D is in the range defined between about 15% of the circular arc length C and about 30% of the circular arc length C.

With reference to FIG. 3, the leading side of each rib 110 defined by the length G includes the leading planar surface oriented at an acute angle X to a radial line extending from the closure central longitudinal axis through the leading end or edge of the leading planar surface defined by the length G. In the preferred embodiment illustrated in FIG. 3, the included acute angle X is in the range defined between about 35 degrees and about 55 degrees.

Further, in the presently preferred embodiment illustrated in FIG. 3, the ribs 110 extend a radial distance A beyond the inner circular arc surface 130 which is defined at the end of the radius $R_2$. In the preferred embodiment, the radial distance A is in the range defined between about 80% of the leading planar surface length G and about 100% of the leading planar surface length G.

As can be seen in FIG. 3 for the preferred embodiment, the hook-like configuration of the rib trailing side extends in the unscrewing direction for a distance F beyond the maximum depth of the recess 128 in the screwing on direction. In the preferred embodiment, the distance F is in the range defined between about 20% of the radial distance A and about 40% of the radial distance A.

In the preferred embodiment illustrated in FIG. 3, the greatest radial extent of each of the ribs 110 defines the largest circumference of the closure having the radius $R_1$, and the ribs 110 each define an outer circular arc surface 136 along the largest circumference at the radius $R_1$.

As previously described, two adjacent ribs 110 define between them the a circular arc length C (FIG. 3) as measured along the largest circumference (at radius $R_1$) between a point on one rib at the largest circumference and a corresponding point on the other rib 110 at the largest circumference. Each rib 110 has an outer circular arc surface 136 that has a circular arc length E. In the preferred embodiment illustrated in FIG. 3, the outer circular arc surface length E is in the range defined between about 10% of the circular arc length C and about 25% of the circular arc length C.

In the preferred embodiment illustrated in FIG. 3, the circular arc surface defining the recess 128 on each rib has a radius $R_3$ which is in the range defined between about 20% of the radial distance A and about 30% of the radial distance A.

In the preferred embodiment illustrated in FIG. 3, the radial outermost portion of each hook-like configuration of each rib 110 begins to curve more sharply radially inwardly away from the outer circular arc surface 136, and the tangent point of the change in curvature between the outer circular arc surface 136 and the trailing edge of the hook-like projection is a distance B as measured from the maximum projection of the hook-like configuration in the unscrewing direction.

The novel rib configuration permits an automatic or automated capping machine to grip the closure body 42 with an enhanced, or stronger, engagement so that a greater torque can be applied to the closure 40 as it screwed on to the container. In particular, FIG. 4 illustrates a simplified view of the rollers 140 of an automatic capping machine which are engaged with the periphery of the closure 40 for applying the closure 40 to a container (not illustrated). Each roller 140 is typically made from a somewhat resilient material, such as rubber or a synthetic polymeric material having a suitable softness and resiliency.

Figure 7:
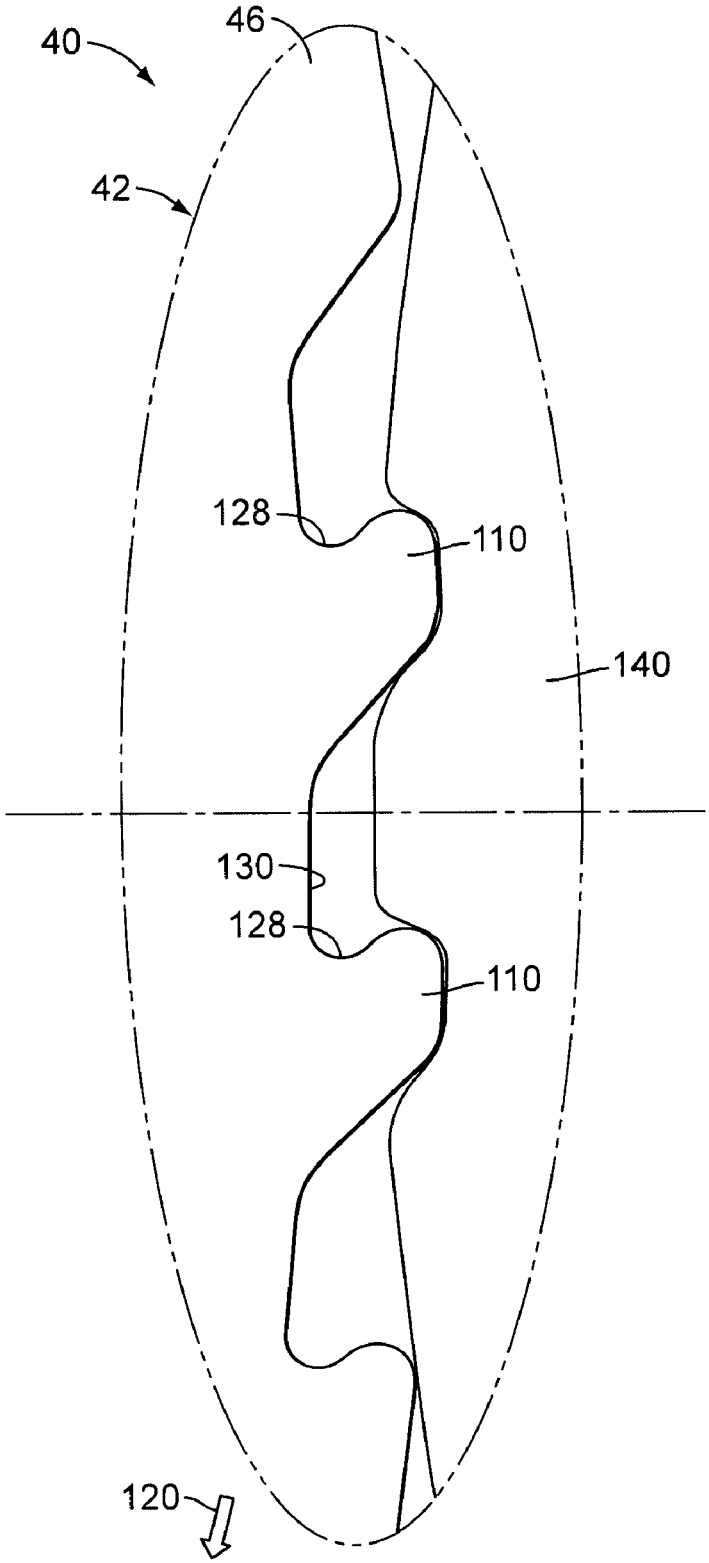
FIG. 7 is a greatly enlarged, plan view of the portion of the drawing designated as "FIG. 7" in FIG. 5.

As can be seen in FIG. 5, when the rollers 140 are rotated in the direction of the arrows 156 against the closure 40, the closure 40 is rotated in the clockwise, screwing on direction 120. The soft, resilient material of the rollers 140 compresses somewhat, and as can be seen in FIG. 7, the material of the rollers 140 can partially conform to, and partially envelop, a distal portion of an engaged rib 110. The material of the roller 140 may extend even further into the spaces between the ribs 110 than as illustrated FIG. 7—depending upon the size of the ribs 110, the spacing between the ribs 110, the softness of the material of the roller 140, and the lateral force with which the rollers 140 are engaged with the ribs 110. It is contemplated that if the dimension C is large enough and the roller material is soft enough, the roller material may extend at least part way into the region adjacent arc surfaces of the rib recesses 128. The roller material might even engage the inner circular arc surface 130 between the ribs.

Figure 8:
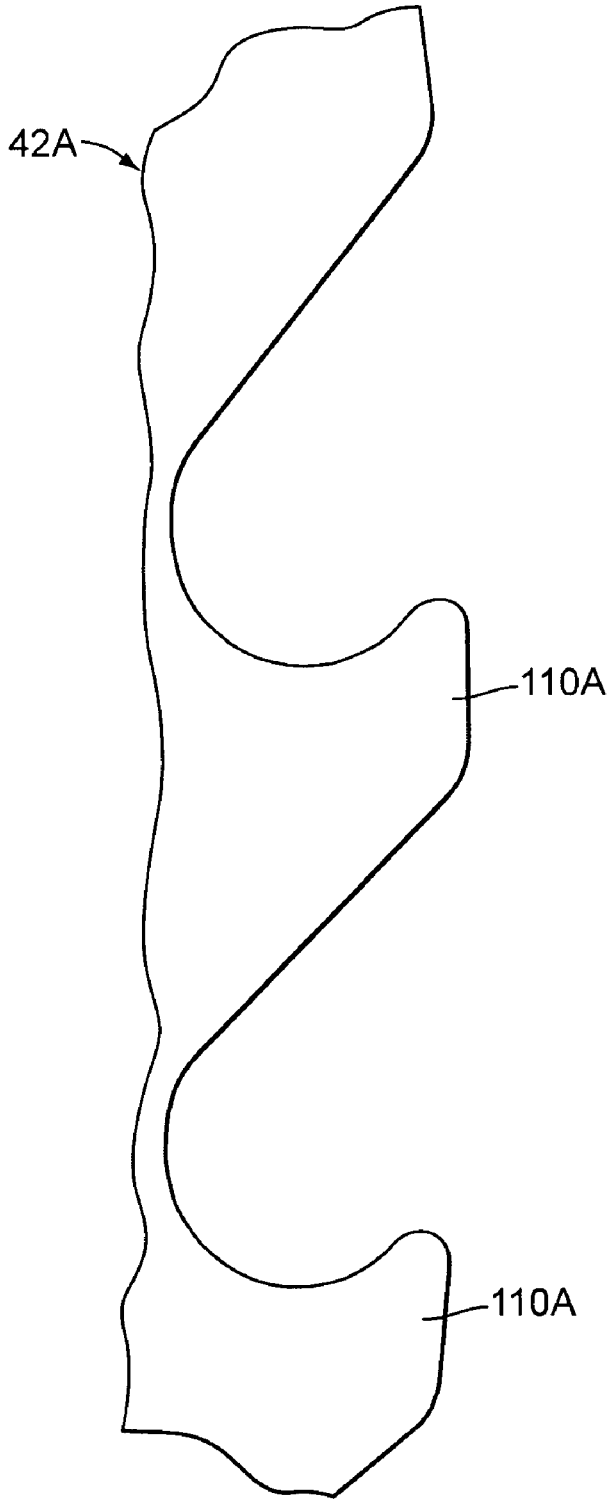
FIG. 8 is a view similar to FIG. 3, but FIG. 8 shows a second embodiment of a rib configuration on the sidewall or skirt of a closure body.

A second embodiment of the rib configuration is illustrated in FIG. 8 wherein each rib is designated generally by the reference number 110 A on a closure body 42A. Compared with the first embodiment illustrated in FIGS. 1-7 described above, the second embodiment illustrated in FIG. 8 does not have an inner convex circular arc surface like the inner convex circular arc surface 130 of the first embodiment. Further, the second embodiment ribs 110 A have a somewhat "sharper" configuration projecting toward the unscrewing direction of rotation, and the second embodiment ribs 110 A project radially outwardly somewhat further.

If desired, the ribs 110 or 110 A need not project outwardly beyond, or even be coextensive with, the farthest radial projection of the overlying closure lid. That is, the ribs 110 or 110 A may project radially somewhat less than the maximum radial projection of the overlying closure lid. However, any projection of the overlying closure lid beyond the closure body ribs must not be so great as to prevent sufficient engagement of the automatic capping machine roller material with the ribs.

It will be readily observed from the foregoing detailed description of the invention and from the illustrations thereof that numerous other variations and modifications may be effected without departing from the true spirit and scope of the novel concepts or principles of this invention.

What is claimed is:

1. A closure for a container that has an opening to the container interior where a product may be stored and that has a screw thread form, said closure comprising:

(A) a screw thread form for engaging said container screw thread form to permit said closure to be screwed onto the container; and (B) a peripheral, grippable wall having a plurality of circumferentially spaced ribs wherein at least some of said ribs each have (1) a leading side that generally faces toward the screwing on direction of rotation; and (2) a trailing side that (a) generally faces toward the unscrewing direction of rotation, and (b) has a hook-like configuration defining a recess which is open toward the unscrewing direction of rotation, in which said hook-like configuration has a distal end that is radially outwardly of said recess and that defines a projection extending toward the unscrewing direction of rotation relative to said recess;

said closure wall between two adjacent ribs at the roots of the ribs defining an inner convex circular arc surface lying on a circular locus having a radius R2, in which at least some of said ribs extend a radial distance A beyond said inner convex circular arc surface radius R2;

said projection of said rib trailing side extending in the unscrewing direction a distance F beyond the maximum depth of said recess as measured in the screwing on direction;

said distance F being in the range defined between about 20% of radial distance A and about 40% of radial distance A.

2. The closure in accordance with claim 1 in which the greatest radial extent of at least some of said ribs defines the largest circumference of said closure having a radius R1;

said closure wall between two adjacent ribs at the roots of the ribs defines an inner convex circular arc surface lying on a circular locus having said radius R2; and about 20% of radial distance A and about 40% of radial distance A.

3. The closure in accordance with claim 2 in which R2 is in the range defined between about 92% of radius R1 and about 98% of radius R1.

4. The closure in accordance with claim 2 in which said inner circular arc surface between two adjacent ribs at the roots of the ribs has an arc length D;

two adjacent ribs define between them a circular arc length C as measured along said largest circumference between a point on one rib at said largest circumference and a corresponding point on the other rib at said largest circumference; and arc length D is in the range defined between about 25% of circular arc length C and about 35% of circular arc length C.

5. The closure in accordance with claim 1 in which said rib leading side includes a leading planar surface oriented at an included acute angle X to a radial line extending from the closure central longitudinal axis through the leading edge of said leading planar surface.

6. The closure in accordance with claim 5 in which said included acute angle X is in the range defined between about 35 degrees and about 55 degrees.

7. The closure in accordance with claim 5 in which said rib leading planar surface has a length G;

said distance A said radial distance A is in the range defined between about 80% of length G and about 100% of length G.

8. The closure in accordance with claim 1 in which the greatest radial extent of at least some of said ribs defines the largest circumference of said closure having a radius R1;

said ribs each define an outer convex circular arc surface lying on said largest circumference;

two adjacent ribs define between them a circular arc length C as measured along said largest circumference between a point on one rib at said largest circumference and a corresponding point on the other rib at said largest circumference;

said outer convex circular arc surface has a circular arc length E; and said arc length E is in the range defined between about 10% of circular arc length C and about 25% of circular arc length C.

9. The closure in accordance with claim 2 in which each said recess is defined at least in part by a circular arc surface having a radius R3;

at least some of said ribs each extend a radial distance A beyond said inner convex circular arc surface radius R2; and said radius R3 is in the range defined between about 20% of radial distance A and about 30% of radial distance A.

* * * * *